United States Patent [19]

Baron

[11] Patent Number: 4,561,495

[45] Date of Patent: Dec. 31, 1985

[54] ALIGNMENT OF BASKET RETAINER CLIPS FOR HEAT EXCHANGER TUBE CLEANING ELEMENTS

[75] Inventor: Walter J. Baron, Mequon, Wis.

[73] Assignee: Water Service of America, Inc., Milwaukee, Wis.

[21] Appl. No.: 645,824

[22] Filed: Aug. 31, 1984

Related U.S. Application Data

[63] Continuation-in-part of Ser. No. 533,143, Sep. 16, 1983, abandoned, and a continuation-in-part of Ser. No. 533,134, Sep. 16, 1983, abandoned.

[51] Int. Cl.[4] ..... F28G 1/12

[52] U.S. Cl. ..... 165/95; 15/3.51; 15/104.06 R

[58] Field of Search ..... 165/95; 15/3.51, 104.06 R

[56] References Cited

U.S. PATENT DOCUMENTS 3,319,710 5/1967 Heeren et al. ..... 165/95
4,124,065 11/1978 Leitner et al. ..... 165/95
4,418,747 12/1983 Baron ..... 165/95
4,489,776 12/1984 Baron ..... 165/95

*Primary Examiner*—Allen M. Ostrager
*Attorney, Agent, or Firm*—Andrus, Sceales, Starke & Sawall

[57] ABSTRACT

A heat exchanger (1) has a housing (2) containing a plurality of fluid flow tubes (5) through which tube cleaning elements (18) are propelled between elongated baskets (17) mounted in communication with the tube ends. The baskets include longitudinally extending slots (22). A removable retainer (28) is adapted for mounting to each outer basket end. The retainer includes a central body portion (29) of molded plastic and a plurality of circumferentially spaced clips (30) for latching onto the basket. Each clip includes a first longitudinally outwardly extending leg (31), a second longitudinally inwardly extending leg (33), and a reverse bend loop (32) joining the legs. A radially extending rib (38) is formed in the reverse bend loop and is connected at its ends to the first and second legs. The ribs on circumferentially spaced clips are of such a length as to normally hold all of the legs in parallelism.

3 Claims, 5 Drawing Figures

ALIGNMENT OF BASKET RETAINER CLIPS FOR HEAT EXCHANGER TUBE CLEANING ELEMENTS

This is a continuation-in-part application of Ser. No. 06/533,143, filed Sept. 16, 1983, inventor, Walter J. Baron, entitled Alignment of Basket Retainer Clips for Heat Exchanger Tube Cleaning Elements, now abandoned, and Ser. No. 06/533,134, filed Sept. 16, 1983, inventor, Walter J. Baron, entitled Heat Exchanger Tube Cleaning Element Capturing Device with Retainer Rotation Prevention, now abandoned.

U.S. PRIOR ART OF INTEREST

| U.S. Pat. No. | Inventor | Issue Date |
|---|---|---|
| 3,319,710 | Heeren et al. | May 16, 1967 |
| 4,124,065 | Leitner et al. | Nov. 7, 1978 |

BACKGROUND AND SUMMARY OF THE INVENTION

This invention relates to alignment of basket retainer clips for heat exchanger tube cleaning elements.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through openings in the basket walls. Upon reversal of fluid flow, the cleaning elements are forced out of their baskets and through the tubes to the baskets at the opposite tube ends to thereby perform a tube cleaning action.

Many baskets are designed of plastic and with their elongated body portions formed by alternating ribs and fluid flow-through slots which terminate in an annular outer end ring. The inner edge portion of the ring is alternately joined to the ribs or exposed to form the outer slot ends. For purposes of retaining a cleaning element within the basket and yet allowing the cleaning element to be removed for more complete access to the tube interiors, a retainer has been removably attached to the outer basket end. One form of retainer has comprised a central body supporting a plurality of flexible clips which extend longitudinally inwardly. The clips are provided with end prongs and stop projections spaced therefrom. When the retainer is assembled onto the basket, the prongs snap into the slots and the stop projections engage the outer edge of the basket end ring to limit entry of the retainer into the basket.

The basket retainers are often formed of molded plastic, and with the clips having legs first extending longitudinally outwardly and then forming a reverse loop base portion with the legs being bent back upon themselves so that the legs extend longitudinally inwardly along the retainer central body. For proper functioning of the snap-in retainer, it is highly desirable that the clip legs are parallel to the said central body and to each other.

It has been found that upon release from the molding die, at least some of the clip legs tend to be collapsed radially inwardly from their base portions. When a retainer having freely collapsed clip legs is inserted into a basket, the prongs may not fully engage with the end edges of the slots.

It is a task of the invention to eliminate the clip leg collapse and assure that the legs are in general parallelism with the longitudinal retainer axis when they are inserted into the basket.

In accordance with the various aspects of the invention, a leg joining element is molded into the clip so that the legs are prevented from collapsing when the retainer is released from the die. More specifically, a radial rib means is formed at the base of the loop and joins the longitudinally outwardly and inwardly extending clip leg portions to spread the clip legs into parallelism with the retainer axis.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
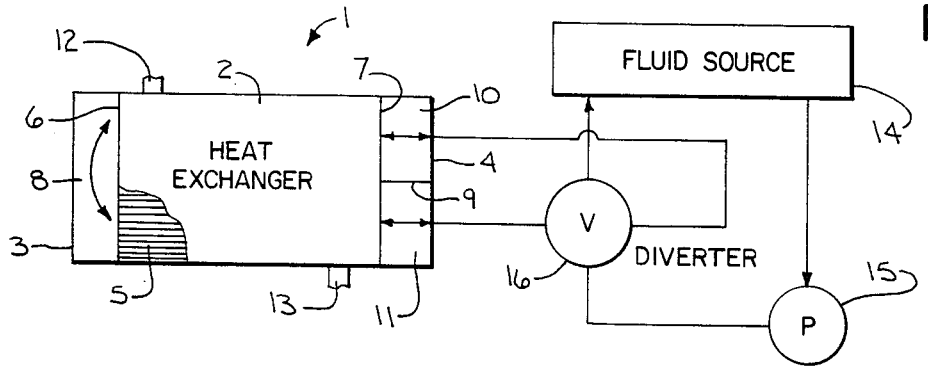
FIG. 1 is a schematic showing of a heat exchanger and fluid flow controls therefor.

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Figure 2:
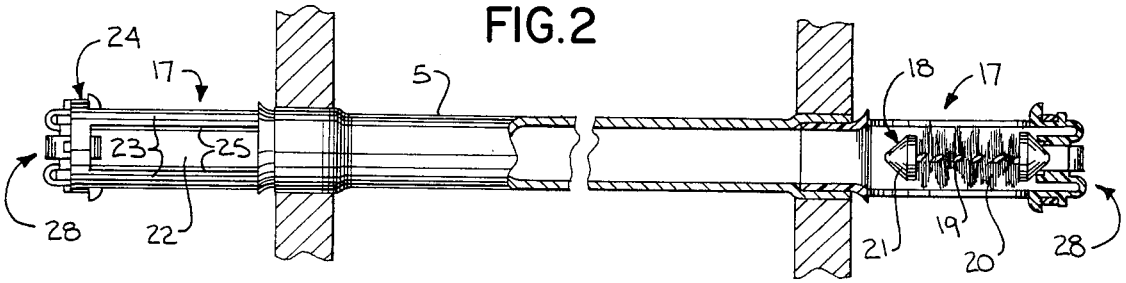
FIG. 2 is a longitudinal section through a typical heat exchanger tube mounted in fragmentarily shown tube sheets where the tube has a capturing chamber connected at each end and in one of which chambers there is a tube cleaning element.

Heat exchanger 1 is provided with tube cleaning means. For this purpose, and as shown in FIG. 2, a plurality of assemblies are disposed in chambers 8, 10 and 11 and include longitudinally extending elongated baskets 17 which are mounted to tube sheets 6 and 7 so that they are in fluid communication with the interiors of tubes 5.

Each pair of opposed baskets 17 is adapted to capture and hold a shuttling cleaning element, such as a brush 18, which moves back and forth between the basket pair through the respective tube 5, depending upon the setting of valve 16. FIG. 2 illustrates one brush 18 disposed in one end basket 17. Brush 18 generally comprises a stem 19 holding an elongated spiral array of brush bristles 20 and conical end caps 21.

Each basket 17 has a central body portion comprising a plurality of alternate fluid flow slots 22 and ribs 23 which terminate at their outer ends in an annular ring 24 forming the outer end portion of the basket. Opening ribs 23 are shown as having slightly different widths. Each slot 22 is delineated by longitudinal elongated side edges 25 formed by a pair of ribs 23, and an outer end edge 26 formed by an inner edge portion of ring 24. Ring 24 also has an annular outer edge 27.

Figure 3:
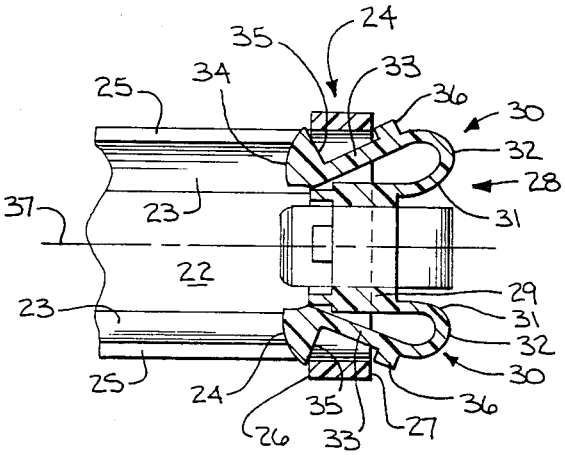
FIG. 3 PRIOR ART
FIG. 3 is an enlarged fragmentary side elevation of the outer end of a cleaning element capturing basket, with parts broken away, and illustrating in somewhat exaggerated form the prior problem of retainer clip leg collapse.

For purposes of at least partially closing the outer basket opening and referring to FIG. 3, a removable cleaning element retainer 28 of molded plastic is mounted to the basket end. As shown, retainer 28 includes a rectangular central body portion 29. A plurality of circumferentially spaced flexible clips 30 are integrally connected to body portion 29. Clips 30 each include a longitudinally outwardly extending leg 31 which merges into a looped clip base 32 which in turn merges into an elongated longitudinally inwardly extending leg 33. In effect, clip 30 is bent back upon itself with base 32 forming a reverse bend.

A radially outwardly extending prong 34 is disposed on the inner end portion of clip leg 33 and is intended to snap into a slot 22 when retainer 28 is inserted into basket 17. Prong 34 is provided with a longitudinally outwardly facing surface 35 which is intended to firmly latch behind ring 24 on edge 26. A projection 36 spaced longitudinally outwardly from prong 34 act as a stop to limit inward travel of retainer 28.

FIG. 3 illustrates the problem encountered with the known construction. In this instance, clip legs 33 are collapsed radially inwardly in a permanent set due to the molding operation so that prong surfaces 35 and projections 36 barely engage ring 24. As can be seen, the clips 30 are distorted.

Figure 4:
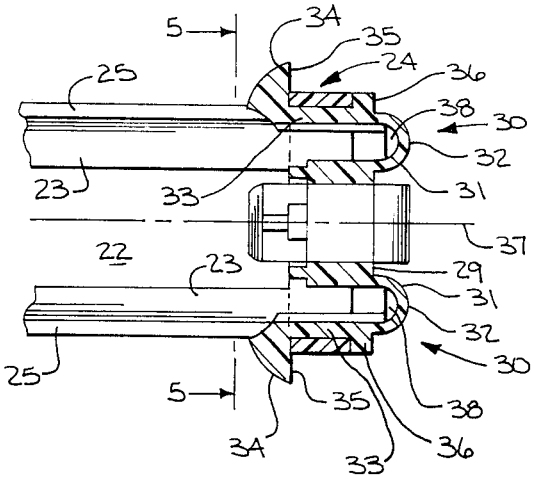
FIG. 4 is a view similar to FIG. 3 and showing the improved retainer.
Figure 5:
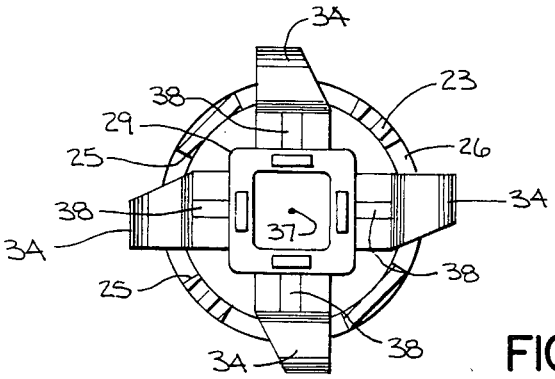
FIG. 5 is a transverse section taken on line 5—5 of FIG. 4.

FIGS. 4 and 5 illustrate the solution to the problem. In accordance with the various aspects of the invention, means are provided in the clips 30 to permanently and firmly hold legs 33 from freely collapsing radially inwardly upon removal from the mold and out of parallelism with each other and with the longitudinal axis 37 of base 29. For this purpose, and in the present embodiment, a generally radially extending rib 38 is integrally formed adjacent the loop of clip base 32 and with its ends joining clip legs 31 and 33. Rib 38 is of a length to spread legs 31 ad 33 into parallelism, and hold them there. The use of multiple ribs 38 on multiple clips 30 assures that all the clip legs are held in parallelism, with legs 33 only subject to temporary flexing upon insertion of retainer 28 into basket 17. Prong surfaces 35 and stop projections 36 fully engage the respective edges of ring 24 so that retainer 28 is securely locked in place.

The concepts of the invention provide a simple yet effective solution to the problem of clip distortion caused by the molding process.

While a basket separate from the tube end is shown in the drawings, a basket integral with the tube could be utilized without departing from the spirit of the invention.

Various modes of carrying out the invention are contemplated as being within the scope of the following claims particularly pointing out and distinctly claiming the subject matter which is regarded as the invention.

I claim:

1. For use in a heat exchanger having a housing containing a plurality of fluid flow tubes through which tube cleaning elements are propelled between elongated baskets at the tube ends, and wherein said baskets include longitudinally extending slots terminating in outer end edges, a removable retainer for mounting to an outer basket end and comprising:

(a) a central body portion of molded plastic and with said body portion having a longitudinal axis, (b) a plurality of flexible circumferentially spaced clips integrally attached to said central body portion, said clips including: a first longitudinally outwardly extending leg which merges into a reverse bend loop forming a clip base, and which in turn merges into a second longitudinally inwardly extending leg, (c) means on said second leg for latching with the outer end slot edges of the basket upon insertion of said retainer thereinto, (d) and means disposed within said clip base adjacent said reverse bend loop for joining said first and second legs so that said second leg is normally disposed in parallelism with said first leg and said axis.

2. The retainer of claim 1 wherein said joining means comprises:

(a) generally radially extending rib means disposed within said reverse bend loop and connected at its ends to said first and second legs, (b) the length of said rib means being such as to normally hold said first and second legs in parallelism.

3. The retainer of claim 1 or 2 wherein said joining means on circumferentially spaced clips places all of said second clip legs in parallelism with each other.

* * * * *